US009206557B2

(12) United States Patent
Theurer et al.

(10) Patent No.: US 9,206,557 B2
(45) Date of Patent: Dec. 8, 2015

(54) MACHINE FOR REMOVING BALLAST FROM A TRACK

(75) Inventors: Josef Theurer, Vienna (AT); Herbert Woergoetter, Gallneukirchen (AT)

(73) Assignee: Plasser & Theurer Export von Bahnbaumaschinen, Gesellschaft m.b.H., Vienna (AT)

( * ) Notice: Subject to any disclaimer, the term of this patent is extended or adjusted under 35 U.S.C. 154(b) by 0 days.

(21) Appl. No.: 14/238,106

(22) PCT Filed: Aug. 23, 2012

(86) PCT No.: PCT/EP2012/003561

§ 371 (c)(1),
(2), (4) Date: Feb. 10, 2014

(87) PCT Pub. No.: WO2013/037450

PCT Pub. Date: Mar. 21, 2013

(65) Prior Publication Data

US 2014/0190045 A1 Jul. 10, 2014

(30) Foreign Application Priority Data

Sep. 15, 2011 (AT) ..... A 1324/2011

(51) Int. Cl.
*E01B 27/04* (2006.01)

(52) U.S. Cl.
CPC ..... *E01B 27/04* (2013.01)

(58) Field of Classification Search
USPC ..... 37/104, 105, 107, 190, 352, 354, 368, 37/369
IPC ..... E01B 27/04,27/021
See application file for complete search history.

(56) References Cited

U.S. PATENT DOCUMENTS

| | | | | | |
|---|---|---|---|---|---|
| 2,886,904 | A | * | 5/1959 | Kershaw | 37/104 |
| 3,436,848 | A | * | 4/1969 | Fekete et al. | 37/104 |
| 4,563,826 | A | * | 1/1986 | Whitaker, Jr. | 37/97 |
| 4,579,060 | A | * | 4/1986 | Nameny et al. | 104/9 |
| 4,674,208 | A | * | 6/1987 | Whitaker, Jr. | 37/104 |
| 5,201,127 | A | * | 4/1993 | Whitaker, Jr. | 37/107 |

(Continued)

FOREIGN PATENT DOCUMENTS

| | | |
|---|---|---|
| AT | 117 118 B | 4/1930 |
| CH | 633 598 A5 | 12/1982 |

(Continued)

OTHER PUBLICATIONS

Translation of JP 2000-178903.*

(Continued)

*Primary Examiner* — Gary Hartmann
(74) *Attorney, Agent, or Firm* — Collard & Roe, P.C.

(57) ABSTRACT

The invention relates to a clearing device (5) provided for removing ballast below a track (4), which clearing device comprises a clearing beam (10) of a clearing chain (11) that can be positioned below the track (4) in a ballast bed (6) and pivoted about a vertical axis of rotation (7). An end (12) of the clearing beam (10) that is distanced from the axis of rotation (7) can be connected by a releasable coupling (13) to a supporting device (14) fastened to the machine frame (1). In order to pivot jointly with the clearing beam (10), the supporting device is fastened to the machine frame (1) via a linkage (16) that is distanced from the coupling (13) and has a pivot axis (15).

10 Claims, 5 Drawing Sheets

(56) References Cited

U.S. PATENT DOCUMENTS

| | | | | |
|---|---|---|---|---|
| 5,271,166 | A * | 12/1993 | Theurer | 37/104 |
| 6,598,325 | B2 * | 7/2003 | Theurer et al. | 37/104 |
| 7,845,098 | B1 * | 12/2010 | Huebner et al. | 37/104 |
| 2006/0096131 | A1 * | 5/2006 | Hall | 37/104 |

FOREIGN PATENT DOCUMENTS

| | | | |
|---|---|---|---|
| FR | 2 658 843 | A1 | 8/1991 |
| FR | 2 717 510 | A1 | 9/1995 |
| JP | 2000-178903 | * | 6/2000 |

OTHER PUBLICATIONS

International Search Report of PCT/EP2012/003561, mailed May 11, 2012, 4 pages.

* cited by examiner 1
2
3
4
5
6
7
9
10
11
12
13
14
15
16
17
18
19
20
22
23
24
25
27
29
30
31
32
33
34
35
36
37
38
39
40
41
43
44
45
46
48
51

MACHINE FOR REMOVING BALLAST FROM A TRACK

CROSS REFERENCE TO RELATED APPLICATIONS

This application is a national stage application of PCT/EP2012/003561 filed on Aug. 23, 2012, which claims priority under 35 U.S.C. 119 of Austrian Application No. A1324/2011 filed on Sep. 15, 2011, the disclosure of which is incorporated by reference. The international application under PCT article 21(2) was not published in English.

BACKGROUND OF THE INVENTION

The invention relates to a machine having an endless excavating chain.

A machine of this type including an endless excavating chain is already known from FR 2 658 843 A1. The chain is arranged in a chain guide connected for vertical and transverse adjustment to the machine frame and having a horizontally extending lower arm in the shape of a cutter bar. In working operations, the latter is pivoted inward transversely to the longitudinal direction of the track in the ballast bed underneath the track grid, with the free end of the bar being suspended from the machine frame by means of a support device designed as a hydraulic cylinder.

Further machines of this kind are also known from FR 2 717 510 or AT 117 118.

SUMMARY

It is the object of the present invention to provide a machine of the type mentioned at the beginning which can be employed in an optimal way also in the region of switches.

According to the invention, this object is achieved with a machine of the specified kind in that the support device 14 is adjustable relative to the machine frame 1 for continuous support of the cutter bar 10 independently of the angle α.

Owing to this special configuration of the support device, it is possible in an advantageous way to design the cutter bar with such length so as to allow even the treatment of a switch section. To that end, merely a change of the angle of the cutter bar and support device with regard to the track axis is required while avoiding any retooling operations.

Additional advantages of the invention become apparent from the dependent claims and the drawing description.

BRIEF DESCRIPTION OF THE DRAWINGS

The invention will be described in more detail below with reference to embodiments represented in the drawing in which.

DETAILED DESCRIPTION

Figure 1:
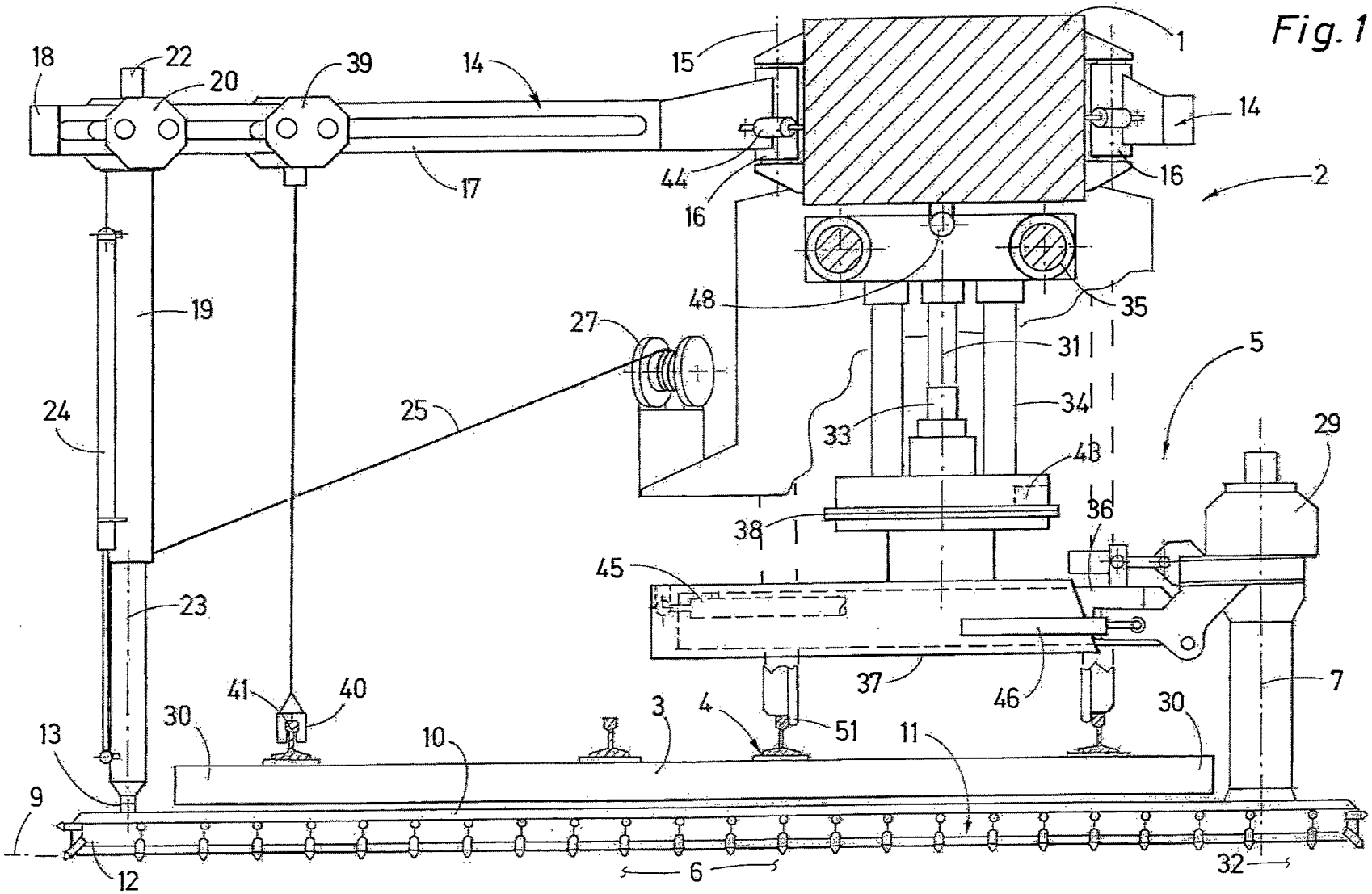
FIG. 1 is a view—in the longitudinal direction of the machine or track—of a clearing device and an associated support device.

A machine frame 1, visible in FIGS. 1 to 4, of a machine 2 for removing ballast of a track 4 is mobile on the track 4 by means of on-track undercarriages 51 arranged at the ends, respectively. The machine 2 is coupled to the undercarriages 51. Provided between the on-track undercarriages is a clearing device 5. The latter comprises a cutter bar 10 of an excavating chain 11, said cutter bar being designed for being positioned in a ballast bed 6 underneath the track 4 and pivotable about a vertical rotation axis 7 by means of a drive 46 in an excavation plane 9 over an angle α. with respect to a longitudinal direction 8 of the track. In the region of the cutter bar 10, the track 4—which, in the illustrated example, is a switch section—is lifted by means of a lifting device, not shown.

An end 12—spaced from the rotation axis 7—of the cutter bar 10 can be connected by means of a detachable coupling 13 to a support device 14 fastened to the machine frame 1. For pivoting together with the cutter bar 10, the support device 14 is mounted on the machine frame 1 via an articulated connection 16 which is distanced from the coupling 13 and has a pivot axis 15. The vertical rotation axis 7 of the cutter bar 10 and the pivot axis 15 of the articulated connection 16 are positioned parallel to one another.

The support device 14 consists of a horizontal beam 17, connected to the machine frame 1 by means of the articulated connection 16 and having a free end 18 spaced from the articulated connection 16, and a vertical beam 19 connected to the free end 18 and comprising the coupling 13. Said vertical beam 19 is connected by means of a travelling trolley 20 to the horizontal beam 17 having a longitudinal direction 21, wherein the travelling trolley 20 is mounted for displacement in the said longitudinal direction 21 and designed to be force-locking fixed to the horizontal beam 17 by means of a blocking device 22.

The vertical beam 19 may be changed as to its length in a longitudinal direction 23 by means of a drive 24 and is connected to a cable 25 of a cable winch 27 arranged on the machine frame 1 in front of the support device 14, with regard to a working direction 26 of the machine 2. The machine 2 has two support devices 14 independent of one another, with their respective articulated connections 16 being spaced from one another in a transverse direction 28 of the machine. Thus it is possible to treat a switch branching off to the left as well as one branching off to the right.

The cutter bar 10 can be rotated, together with a rotation drive 29 for rotating the excavating chain 11, about a rotation axis 31 relative to the machine frame 1 by 180° for selectively positioning the rotation drive 29 in either one of two bedding sections 32, each adjoining sleeper ends 30. The rotation axis 31 is positioned centrally with regard to the transverse direction 28 of the machine and the machine frame 1. The entire clearing device 5 is, on the one hand, vertically adjustable by a drive 33 relative to the machine frame 1 via vertical guides 34 and, on the other hand, also adjustable by a drive 48 in the longitudinal direction of the machine in guides 35.

Figure 2:
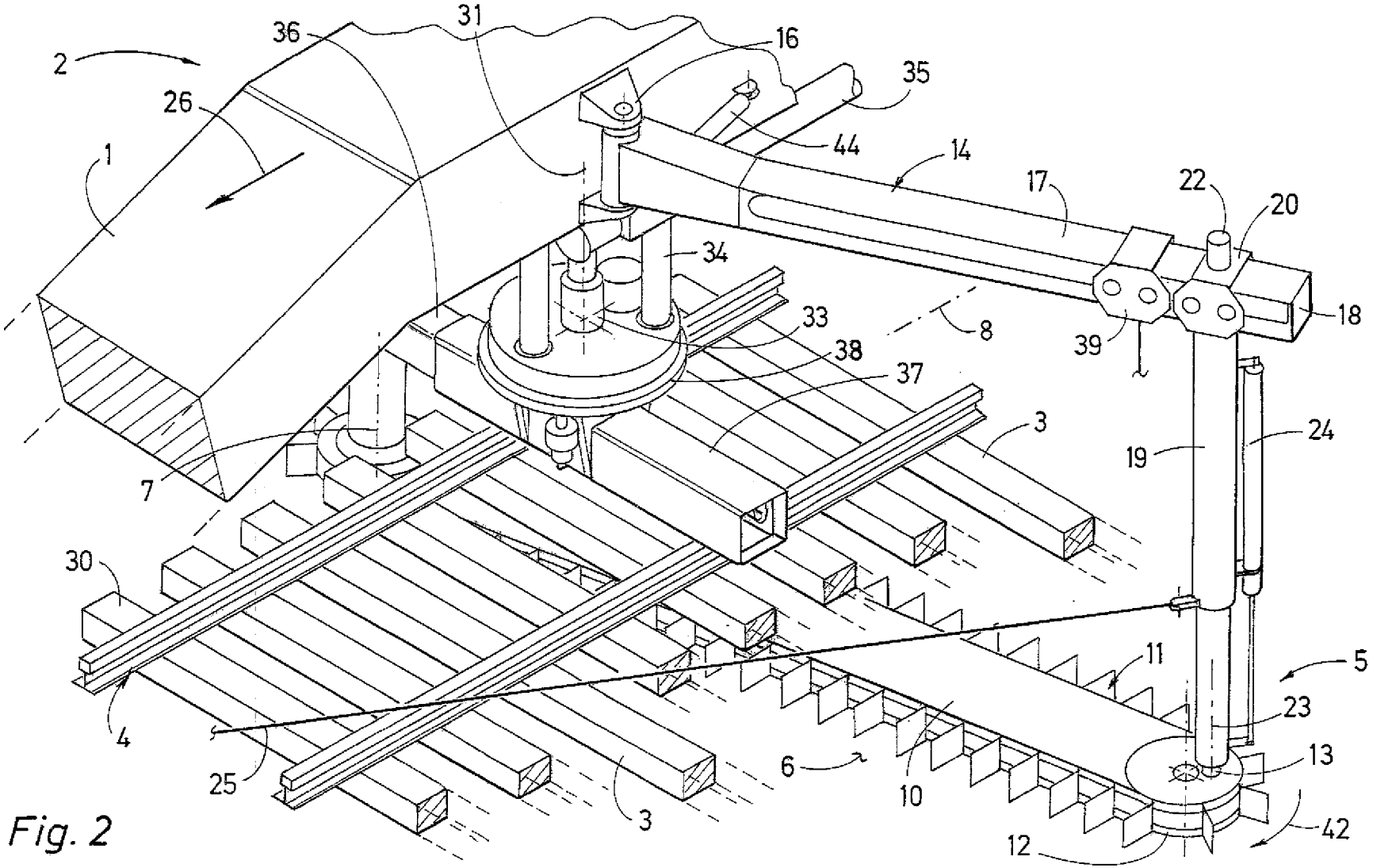
FIGS. 2 and 3 are a perspective view and top view, respectively, of the clearing device, and FIG. 4, 5 each is a further variant of the support device.

As can be seen particularly in FIGS. 1 and 2, the cutter bar 10 together with the rotation drive 29 is connected to a first transverse beam 36 which, in turn, is mounted for displacement in a second transverse beam 37. The latter is connected to a turning device 38 which may be activated via a rotation drive 43 for rotation of the cutter bar 10 about the rotation axis 31.

Between the vertical beam 19 and the articulated connection 16, a second travelling trolley 39 is mounted on the horizontal beam 17 for displacement in the longitudinal direction 21 thereof and connected to rail tongs 40 which can be lowered. These get connected to the rail 41 of a branch track of the switch section in order to assist in the lifting of the track.

The mode of operation of the machine 2 or the clearing device 5 will now be described in more detail.

Figure 3:
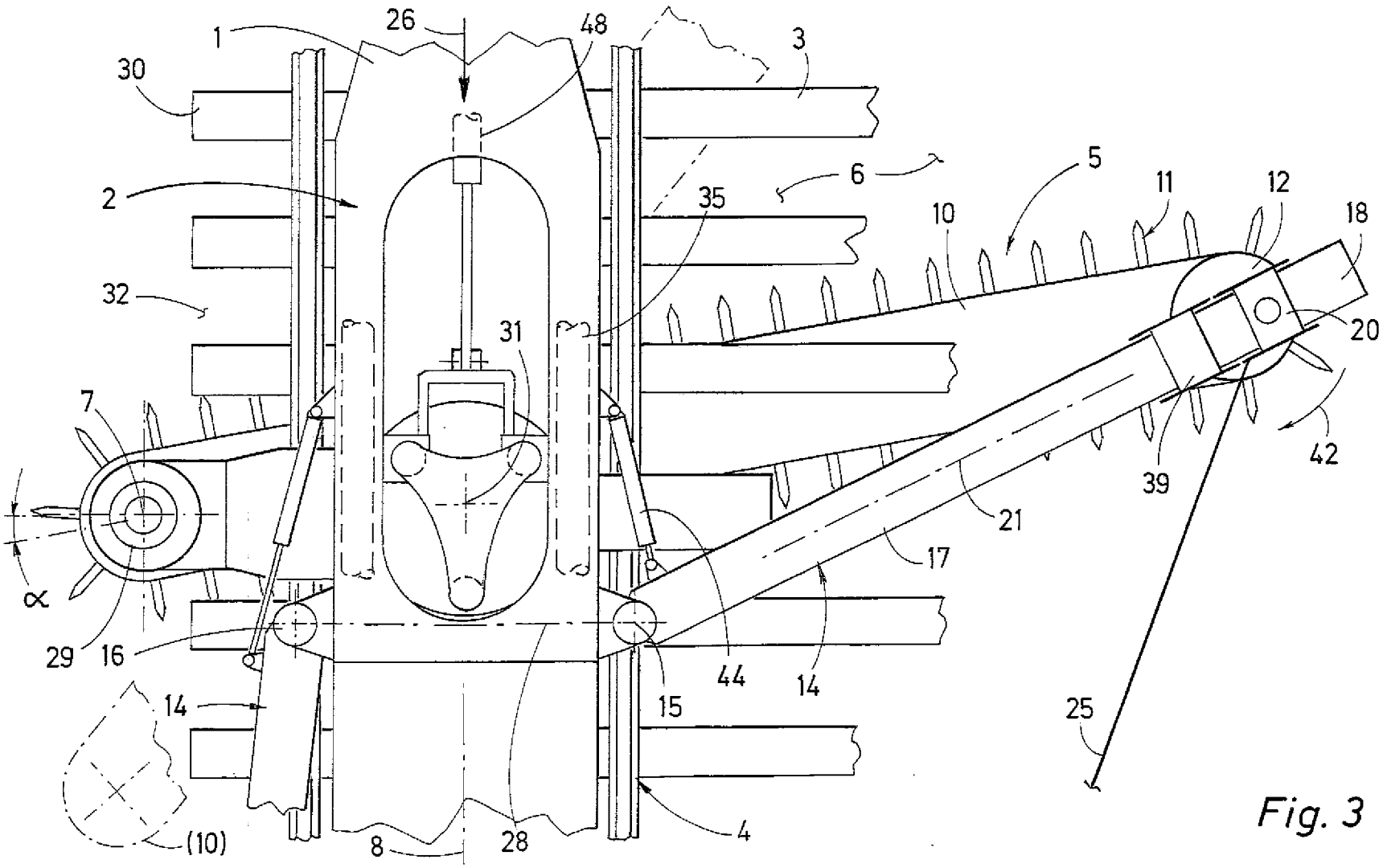

During working operations in a switch-free track section, the cutter bar 10—pivoted inward under the track 4 by the drive 46—encloses a large angle α with respect to the transverse direction 28 of the machine (cf. the position of the cutter bar 10 indicated in dash-and-dot lines in FIG. 3). By rotation of the excavating chain 11 in the direction indicated by an arrow 42, the ballast located under the track 4 is conveyed into the left-hand bedding section 32. There, the accumulated ballast may be picked up, for example, by a shoulder chain following behind. Both support devices 14 are in an inoperative position.

As soon as the sleeper length increases at the beginning of a switch section (in FIGS. 2, 3 on the right-hand side), the angle α is changed—with actuation of the drive 46 as well as assistance by the cable winch 27—in such a way that the free end 12 of the cutter bar 10 always comes to lie in the bedding section 32 adjoining the sleeper ends 30.

Now, with the aid of a drive 44, the right-hand support device 14 (in FIGS. 2, 3) can be distanced from the machine frame 1 in order to connect the coupling 13 of the vertical beam 19 to the free end 12 of the cutter bar 10. The drive 24 enables the length of the vertical beam 19 to be adapted, if needed. By means of the blocking device 22, the position of the vertical beam 19 with regard to the horizontal beam 17 can be fixed. By means of the cable 25, the cable winch 27 is able to transmit to the machine frame 1 forces counteracting the cutter bar 10, thus relieving the drive 46 or the rotation drive 43.

Prior to the subsequent adjustment of the angle for the purpose of adapting to the sleepers which are getting longer, the blocking device 22 must be released temporarily. For better transmission of the track lifting forces, the rail tongs 40 are brought in contact with the rail 41. In the event that a switch section follows in further sequence which has a branch track situated in the left-hand half of the illustration (FIG. 3), the cutter bar 10 can be turned by 180° with regard to the rotation axis 31. To that end, the cutter bar 10 must first be pivoted outward into a position parallel to the longitudinal direction 8 of the track, and the clearing device 5 must be raised by means of the drive 33, until the cutter bar 10 comes to lie above the track 4.

If required, a transverse displacement of the cutter bar 10 relative to the turning device 38 can be effected by means of a further drive 45.

Figure 4:
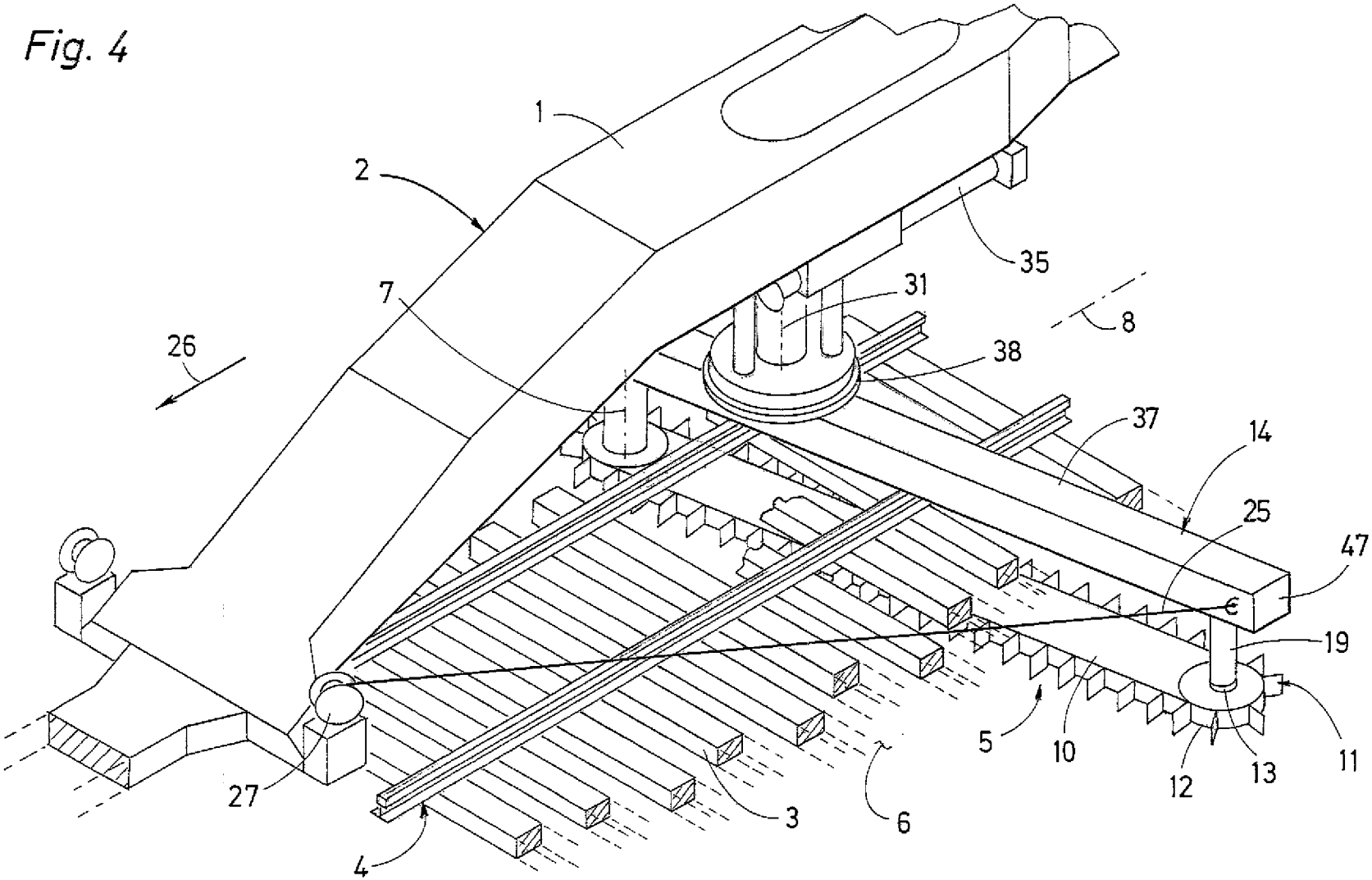

According to an embodiment of the invention shown in FIG. 4 (in which parts having the same function are denoted by the same reference numerals as used before), the support device 14 is designed as an extension of the second transverse beam 37 connected to the turning device 38. A free end 47 of said transverse beam 37 is connected to the length-adjustable vertical beam 19. The latter is coupled via the coupling 13 to the end 12 of the cutter bar 10. Likewise in this embodiment, the support device 14—for common pivoting together with the cutter bar 10—is mounted to the machine frame 1 via an articulated connection designed as a turning device 38 which is spaced from the coupling 13 and has a rotation axis 31.

Figure 5:
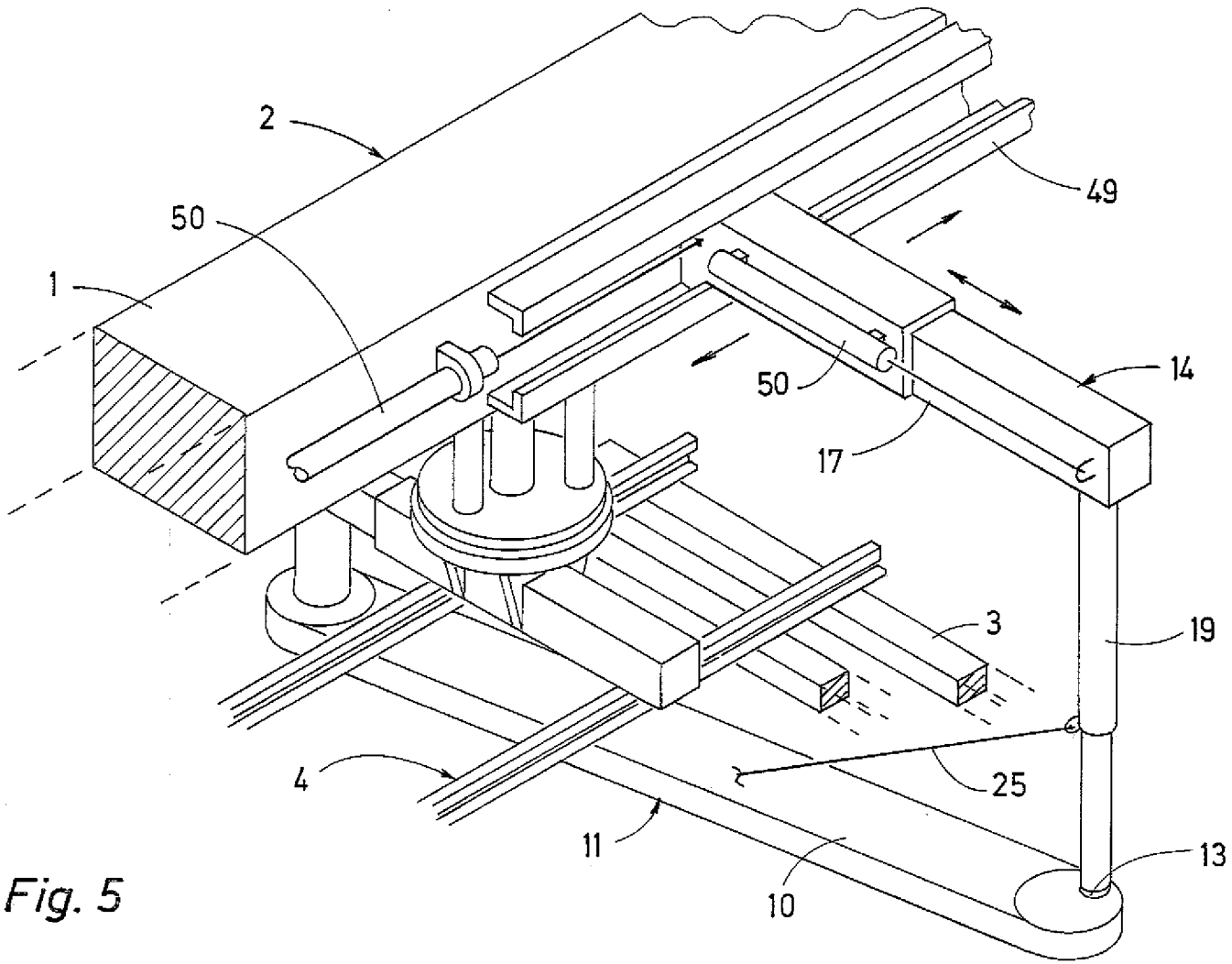

In the variant of the support device 14 shown schematically in FIG. 5, the horizontal beam 17 is connected to the machine frame 1 via a longitudinal guide 49 for displacement in the longitudinal direction of the machine by means of a drive 50. Additionally, the horizontal beam 17 is designed to be telescopically elongatable in its longitudinal direction by means of a further drive 50. As in the already described embodiments, the vertical beam 19 is connected to the cutter bar 10 by means of the coupling 13. Thus, the support device 14 is adjustable relative to the machine frame 1 along the longitudinal guide 49 for the purpose of continuously supporting the cutter bar 10 independently of the angle α.

The invention claimed is:

1. A machine for removing ballast underneath a track comprising:

a machine frame a plurality of on-track undercarriages wherein said machine frame is mobile on the track via said on-track undercarriages;

a clearing device, wherein said machine frame is connected for vertical adjustment to said clearing device;

wherein said clearing device comprises an excavating chain having a cutter bar wherein the cutter bar being designed for being positioned in a ballast bed underneath the track and pivotable about a vertical rotation axis in an excavation plane over an angle α with respect to a longitudinal direction of the track;

a detachable coupling coupled to an end spaced from the rotation axis of the cutter bar a support device coupled by means of said coupling at said end to the cutter bar and fastened to the machine frame, wherein, the support device is adjustable relative to the machine frame for continuous support of the cutter bar independently of the angle α.

2. The machine according to claim 1, wherein, for pivoting together with the cutter bar, the support device is mounted on the machine frame via an articulated connection which is distanced from the coupling and has a pivot axis.

3. The machine according to claim 2, wherein the vertical rotation axis of the cutter bar and the pivot axis of the articulated connection are positioned parallel to one another.

4. The machine according to claim 1, wherein the support device consists of a horizontal beam, connected to the machine frame by means of the articulated connection and having a free end spaced from the articulated connection, and a vertical beam connected to the free end and comprising the coupling.

5. The machine according to claim 4, wherein the vertical beam is connected by means of a travelling trolley to the horizontal beam having a longitudinal direction, and that the travelling trolley is mounted for displacement in the said longitudinal direction.

6. The machine according to claim 4, wherein the vertical beam having a longitudinal direction may be changed as to its length in said longitudinal direction by means of a drive.

7. The machine according to claim 5, wherein a blocking device for selective force-locking connection to the horizontal beam is associated with the travelling trolley.

8. The machine according to claim 4, wherein the vertical beam of the support device is connected to a cable of a cable winch arranged on the machine frame in front of the support device, with regard to a working direction of the machine.

9. The machine according to claim 1, wherein two support devices independent of one another are provided, with their respective articulated connections being spaced from one another in a transverse direction of the machine.

10. The machine according to claim 1, wherein the cutter bar can be rotated, together with a rotation drive for rotating the excavating chain, about a rotation axis relative to the machine frame by 180° for selectively positioning the rotation drive in either one of two bed ding sections, each adjoining sleeper ends.

* * * * *